US011834081B2

(12) United States Patent
Auer

(10) Patent No.: US 11,834,081 B2
(45) Date of Patent: Dec. 5, 2023

(54) TRACK MEASURING VEHICLE AND METHOD FOR RECORDING A VERTICAL TRACK POSITION

(71) Applicant: PLASSER & THEURER EXPORT VON BAHNBAUMASCHINEN GMBH, Vienna (AT)

(72) Inventor: Florian Auer, Vienna (AT)

(73) Assignee: Plasser & Theurer Export von Bahnbaumaschinen GmbH, Vienna (AT)

( * ) Notice: Subject to any disclaimer, the term of this patent is extended or adjusted under 35 U.S.C. 154(b) by 413 days.

(21) Appl. No.: 16/483,315

(22) PCT Filed: Feb. 1, 2018

(86) PCT No.: PCT/EP2018/052459

§ 371 (c)(1),
(2) Date: Aug. 2, 2019

(87) PCT Pub. No.: WO2018/149650

PCT Pub. Date: Aug. 23, 2018

(65) Prior Publication Data

US 2019/0375438 A1 Dec. 12, 2019

(30) Foreign Application Priority Data

Feb. 15, 2017 (AT) ..... A 51/2017

(51) Int. Cl.
*B61K 9/08* (2006.01)
*B61L 23/04* (2006.01)

(52) U.S. Cl.
CPC ..... *B61K 9/08* (2013.01); *B61L 23/047* (2013.01)

(58) Field of Classification Search
CPC ..... B61K 9/08; B61L 23/047
See application file for complete search history.

(56) References Cited

U.S. PATENT DOCUMENTS 5,301,548 A * 4/1994 Theurer ..... E01B 27/17 73/146
7,979,995 B2 * 7/2011 Theurer ..... E01B 35/00 33/287

(Continued)

FOREIGN PATENT DOCUMENTS

AT 516278 A4 4/2016
CN 102337710 A * 2/2012

(Continued)

*Primary Examiner* — Michael J Dalbo
(74) *Attorney, Agent, or Firm* — Laurence A. Greenberg; Werner H. Stemer; Ralph E. Locher

(57) ABSTRACT

A track recording vehicle for detecting the resilience of a rail track has a machine frame supported on two rail-mounted undercarriages. A first measuring system detects a vertical distance of the rail track under load and a second measuring system detects a vertical distance of the rail track under no load or with reduced load. The first measuring system is coupled to an evaluation device for calculating the course of a first vertical sine and the second measuring system determines a course of a second vertical sine, relative to a common reference base defined by two outer measuring points under load, at an interposed central measuring point without or with reduced load. The evaluation device calculates a subsidence of the rail track under load from the two vertical sines. The track recording vehicle detects a subsidence of the rail track under load in a single measuring run.

3 Claims, 2 Drawing Sheets

(56) References Cited

U.S. PATENT DOCUMENTS

| | | | | |
|---|---|---|---|---|
| 9,963,157 | B2 | 5/2018 | Michitsuji et al. | |
| 2009/0070064 | A1 | 3/2009 | Farritor et al. | |
| 2010/0018432 | A1* | 1/2010 | Theurer | E01B 27/20 104/2 |
| 2014/0180609 | A1* | 6/2014 | Berggren | E01B 35/12 702/42 |
| 2015/0377653 | A1* | 12/2015 | Lichtberger | E01B 35/00 356/73 |
| 2016/0207551 | A1 | 7/2016 | Mesher | |
| 2017/0029001 | A1* | 2/2017 | Berggren | G01M 5/0058 |
| 2017/0306568 | A1 | 10/2017 | Lichtberger | |

FOREIGN PATENT DOCUMENTS

| | | | | |
|---|---|---|---|---|
| CN | 102358325 | A | 2/2012 | |
| CN | 202298394 | U | 7/2012 | |
| CN | 103993530 | A | 8/2014 | |
| CN | 105346561 | A | 2/2016 | |
| CN | 105517874 | A | 4/2016 | |
| DE | 4136904 | A1 * | 5/1992 | B61K 9/08 |
| DE | 10220175 | C1 * | 4/2003 | B61K 9/08 |
| DE | 10220175 | C1 | 4/2003 | |
| EP | 1361136 | A1 * | 11/2003 | B61K 9/08 |
| EP | 1361136 | A1 | 11/2003 | |
| JP | 2016011106 | A * | 1/2016 | G01B 11/272 |
| WO | 9514817 | A1 | 6/1995 | |

* cited by examiner

TRACK MEASURING VEHICLE AND METHOD FOR RECORDING A VERTICAL TRACK POSITION

FIELD OF TECHNOLOGY

The invention relates to a track measuring vehicle for recording the resilience of a track, with a machine frame which, supported on two on-track undercarriages, is mobile on the track, with a first measuring system for recording a vertical distance of the track under load and with a second measuring system for recording a vertical distance of the track in the absence of load. In addition, the invention relates to a method of surveying a track by means of the track measuring vehicle.

PRIOR ART

Maintenance of a track takes place on the basis of geometric factors. One of these factors is the vertical track position under load. As a rule, the weight of a track measuring vehicle is used as the load, the vehicle moving along the track and recording the vertical track position in the process.

A further factor used for assessing a track condition is the resilience of the track. In order to record this, the track position must additionally be measured in the absence of load and compared to the track position under load. As a rule, this takes place by means of two separate measurements.

According to DE 102 20 175 C1, a method and a track measuring vehicle are known by means of which the resilience of the track can be recorded in one measuring pass. To that end, two measuring systems are arranged on the track measuring vehicle. A first measuring system records the relative track position under load with respect to a spatially-fixed inertial reference system. During this, a measuring head measuring vertically by means of optical triangulation traces the course of the rail in lateral direction.

A second measuring system records the track position without load with respect to the same reference system by means of a further vertically-measuring measuring head arranged at a system carrier. Necessarily, a lateral tracing of the rails must also take place with the second measuring system. In addition, movements of the track measuring vehicle must be compensated via compensating devices and roll angle compensators. Furthermore, elaborate comparing devices with cameras and light sources are required in order to synchronize the two measuring systems with one another.

SUMMARY OF THE INVENTION

It is the object of the invention to provide a track measuring vehicle of the specified type and a method with which the resilience of the track can be determined in a simple manner.

According to the invention, this object is achieved by way of the features as claimed. Advantageous further developments of the invention become apparent from the dependent claims.

The first measuring system records a course of a first vertical versine under load by means of the known inertial measuring principle or by measuring a vertical axle acceleration, wherein at first a form-accurate measuring signal is determined. In further sequence a three-point signal with respect to a virtual curve chord is calculated by means of an evaluation device, said signal corresponding to the course of the vertical versine in the moving-chord measuring principle (three-point measurement).

The second measuring system is provided for determining a course of a second vertical versine, with a common reference base, with two outer measuring points under load and with a central measuring point, lying there between, without load or with reduced load, wherein the evaluation device is designed for computing from the two versines a subsidence of the track under load. The non-loaded region of the track between the two on-track undercarriages is also included in the measurement of the second versine. With this, it is possible to determine in a simple manner, together with the first versine, the subsidence under load.

Such a track measuring vehicle records the resilience of the track under load in a single measuring pass, wherein it is only necessary to determine the courses of the two vertical versines. Devices for movement compensation or comparing devices for synchronizing the two measuring systems with one another are not required. Thus, a simple and efficient determination of the subsidence of the track takes place with few system components.

A further development provides that the first measuring system is designed as an inertial measuring system and has a measuring frame which is attached to one of the on-track undercarriages. In this manner, a measuring system already present on modern track measuring vehicles is used for determining the course of the first vertical versine of the track under load.

In this, it is advantageous if an inertial measuring unit and at least two position measuring devices for determining the position of the measuring frame relative to the rails of the track are arranged on the measuring frame. Thus, a precise course of both rails of the track is obtained. In order to be able to record such a course independently of a travelling speed of the track measuring vehicle, two position measuring devices spaced from one another are provided per rail.

In a continuing variant of the invention, the second measuring system comprises two outer measuring trolleys for recording the track position at the outer measuring points, and a central measuring trolley for recording the track position at the measuring point lying there between. With this, a robust design exists which allows a direct recording of the second vertical versine.

Advantageously in this, at least one measuring chord is stretched as reference base between the two outer measuring trolleys. For example, it is possible in a simple manner to measure the distance of a centrally stretched steel chord from a measuring device of the central measuring trolley as second vertical versine. With a measuring chord above each rail, a vertical versine can be determined for each rail.

In the case of only a single centrally-stretched measuring chord, it is favourable if each measuring trolley is equipped with a super-elevation measuring device to be able to determine a separate second vertical versine for each rail. This is also favourable if the machine frame is used as a reference base. During this, a continuous distance measurement of the measuring trolleys with respect to the machine frame takes place.

Another continuing variant of the invention provides that the second measuring system comprises contact-less distance measuring devices which are arranged on the machine frame above the three measuring points and which measure a respective distance to a rail of the track. Here, the measuring trolleys are omitted, and the machine frame serves as common reference base. To that end, a particularly stiff machine frame is provided to avoid interfering vibration influences.

The method, according to the invention, of surveying a track by means of the track measuring vehicle provides that the first vertical versine and the second vertical versine are determined with an identical chord length and chord division, and that the two vertical versines are subtracted for computing the subsidence of the track under load. In this manner, the determination of the subsidence under load can be carried out with little computing effort.

In a simple embodiment of the method, the first vertical versine and the second vertical versine are determined in the track center in each case, wherein a median course of subsidence of the track is computed. Such a determination of the subsidence is sufficient in many cases of application.

For a more precise analysis of the track quality, it is favourable if the first vertical versine and the second vertical versine are determined separately for both rails of the track, and if thus a separate course of subsidence is computed for each rail.

BRIEF DESCRIPTION OF THE DRAWINGS

The invention will be described by way of example below with reference to the attached figures. There is shown in schematic representation in.

DESCRIPTION OF THE EMBODIMENTS

Figure 1:
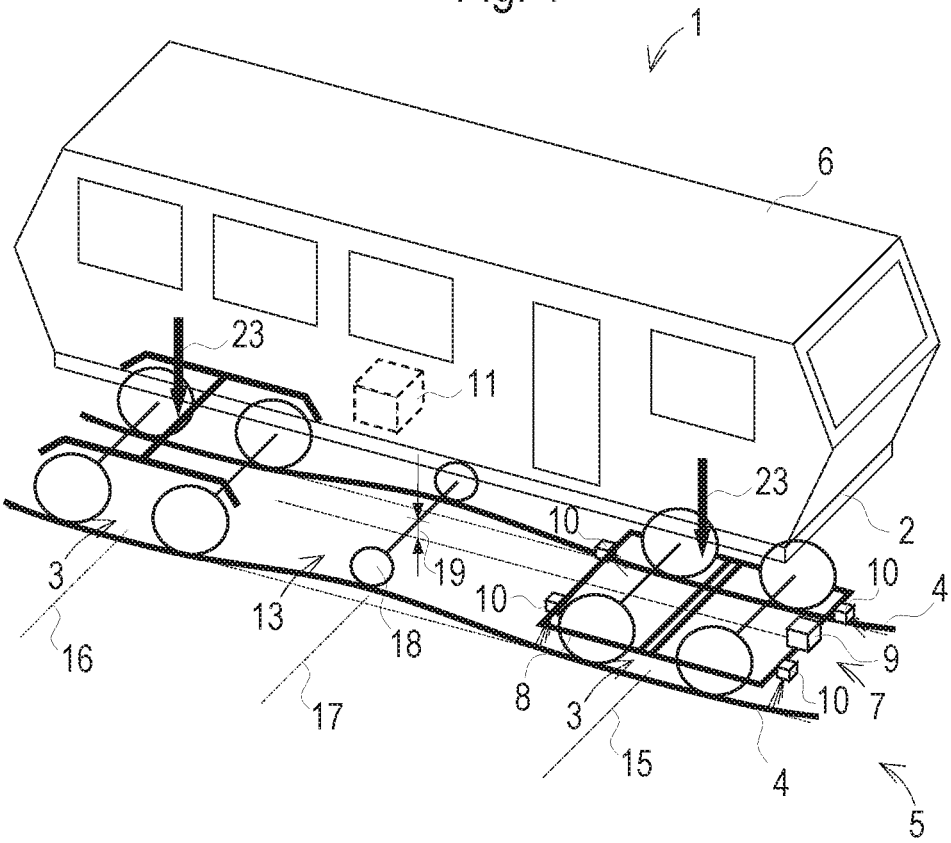
FIG. 1 a track measuring vehicle in a perspective view

FIG. 1 shows a track measuring vehicle 1 having a machine frame 2 which, supported on two on-track undercarriages 3, is mobile on two rails 4 of a track 5. In this, the on-track undercarriages 3 are designed as bogies. A wagon body 6 with driver's or operator's cabs, drive components and various control- and measuring devices is erected on the machine frame 2.

A first measuring system 7 is arranged at one of the on-track undercarriages 3. In FIG. 1, this is a so-called inertial measuring system. In its place, a different measuring system can also be used which records the vertical course of the track 5 under load (for example, measurement of the axle bearing acceleration).

The first measuring system 7 comprises a measuring frame 8 which is connected to the axle bearings of the on-track undercarriage 3 and follows the vertical track position exactly. Connected to the measuring frame 8 is an inertial measuring unit 9. The latter measures each movement with respect to a stationary reference system and supplies a spatial curve in the track center and/or two spatial curves of the rail inner edges.

For mathematical compensation of lateral relative motions of the on-track undercarriage 3 with respect to the track 5, position measuring devices 10 are arranged at four points of the measuring frame 8 (Optical Gauge Measuring System). These continuously record the distances from the inner edges of the rails 4, wherein in the case of a minimum measuring speed two position measuring devices 10 are also sufficient. With this, the track position in the transverse direction can be recorded exactly.

Measurement data recorded by means of the first measuring system 7 are supplied to an evaluation device 11 for computation of the course of a first vertical versine 12 of the track position under load. Additionally, the results of a second measuring system 13 are fed to the evaluation device 11. This second measuring system 13 is provided for determining a course of a second vertical versine 14.

As is known, the vertical distance of a track position or a rail course from a curve chord is specified as vertical versine 12, 14. In this, the so-called moving-chord measuring principle (three-point measurement) is used, wherein a virtual measuring chord is used as reference base for calculation of the first vertical versine 12.

By means of the second measuring system 13, the track position is measured under load at two outer measuring points 15, 16, as seen in the longitudinal direction of the track, and without or with reduced load at a middle measuring point 17 lying there between. The measurements take place with respect to a common reference base corresponding to the determination of the first vertical versine 12.

The second measuring system 13 comprises, for example, a middle measuring trolley 18, suspended on the machine frame 2, which is arranged between the two on-track undercarriages 3 in a non-loaded section of the track 5. The middle measuring trolley 18 has a low weight, which is why the same can remain disregarded. It is also possible to provide a weight-compensating suspension of the middle measuring trolley 18, which merely prevents a lifting-off from the rails 4.

At the two outer measuring points 15, 16, the track 5 is weighted with an approximately equally big load. This is obtained by an even weight distribution of the machine frame 2, including the wagon body 6 and various devices, on the two on-track undercarriages 3. This results in a characteristic subsidence 19 under load for an observed point of the track 5, independently of which on-track undercarriage 3 applies the load.

Figure 2:
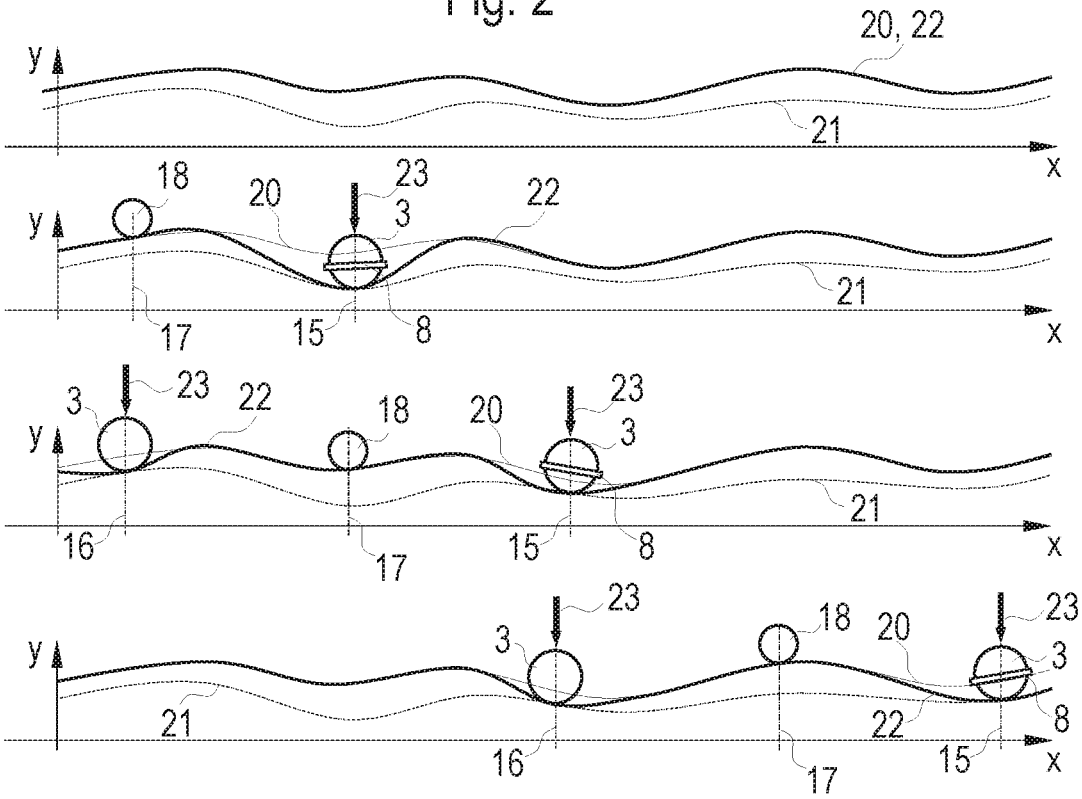
FIG. 2 diagrams of the vertical track position

FIG. 2 shows diagrams with different vertical track positions 20, 21, 22, wherein the x-axis shows a travelling path, and the y-axis shows a vertical deviation from a perfectly plane track position. A thin solid line corresponds to a non-loaded track position 20, and a dashed line corresponds to a track position 21 under load. A heavy solid line shows the actual track position 22 while travelled upon by the track measuring vehicle 1. For better clarity, the deviations versus a plane track position are greatly exaggerated.

In the upper diagram, the track 5 is not yet travelled upon, which is why the non-loaded track position 20 corresponds to the actual track position 22. The three diagrams there below show a chronological sequence during travelling on the track 5. In this, the loads on the track 5 by the on-track undercarriages 3 are represented by means of equal point loads 23. The computation of the course of the first vertical versine 12 by means of the evaluation device 11 is also based on this assumption.

Figure 3:
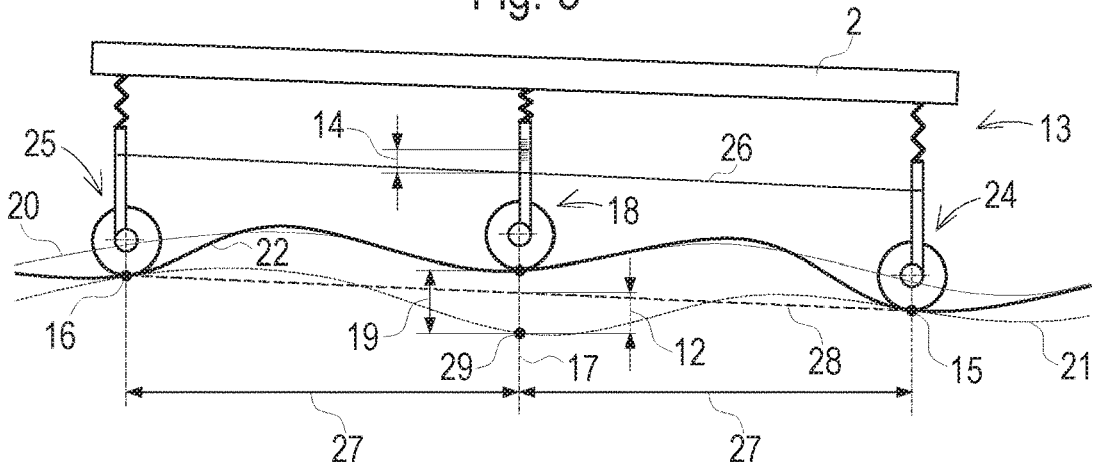
FIG. 3 determination of the second versine by means of measuring trolleys at a first track position FIG. 4 determination of the second versine by means of measuring trolleys at a second track position FIG. 5 determination of the second versine by means of distance measuring devices
Figure 4:
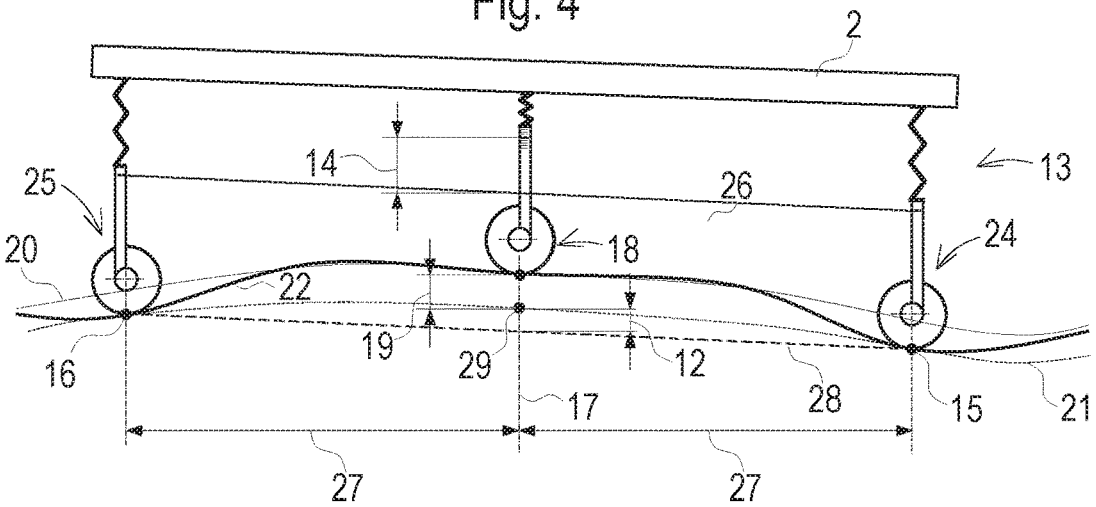
Figure 5:
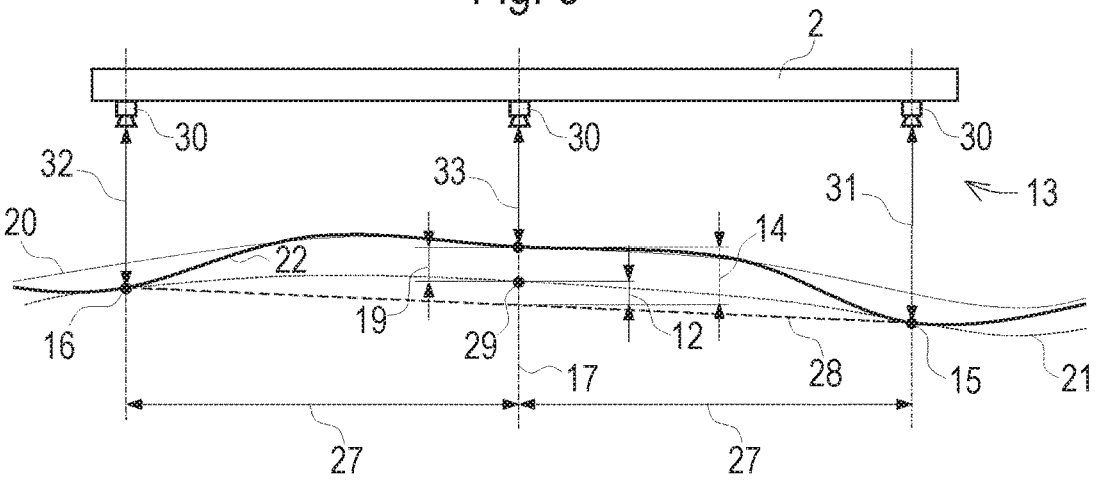

FIGS. 3 to 5 show the geometric correlations in detail, wherein in FIGS. 3 and 4 three measuring trolleys 18, 24, 25 are provided as components of the second measuring system 13. In addition to the middle measuring trolley 18, these are two outer measuring trolleys 24, 25 which are arranged in immediate proximity to the on-track undercarriages 3 and thus in loaded sections of the track 5. A useful variant is also an arrangement of the outer measuring trolleys 24, 25 in each case between the axles of an on-track undercarriage 3 designed as a bogie.

A measuring chord 26 is stretched between the two outer measuring trolleys 24, 25. Alternatively, the machine frame 2 can serve as a common reference base, wherein the same is configured with corresponding stiffness. Additionally, distance measurement devices for recording the distances between the machine frame 2 and the individual measuring trolleys 18, 24, 25 are required.

In the example shown, there is a symmetric chord division. The middle measuring trolley 18 thus has an equal distance 27 to the two outer measuring trolleys 24, 25. However, an asymmetric chord division is also possible. Attention is to be paid to a sufficient distance of the middle measuring trolley 18 to the two outer measuring trolleys 24, 25, so that there is no influence of the loaded track sections on the middle measuring trolley 18.

During travel on the track 5 by the measuring vehicle 1, the second vertical versine 14 is measured continuously by means of this second measuring system 13. In particular, this is the vertical deviation of the middle measuring trolley 18 from the measuring chord 26 versus an arrangement with perfectly plane track position. In a simple embodiment, a versine measurement takes place in the track center. However, it is also possible to measure the vertical versines of the respective rail 4. Then, either a separate measuring chord 26 is stretched above each rail 4, or each measuring trolley 18, 24, 25 comprises a super-elevation measuring device (inclinometer) to infer the longitudinal levels of the rails 4 from a vertical level in the track center.

By means of the evaluation device 11, the computation of the first vertical versine 12 from the stored track position data of the first measuring system 7 takes place. During this, a virtual reference base is used which delivers corresponding results to the second measuring system 13. This is, for example, a virtual measuring chord 28 which connects the outer measuring points 15, 16 and thus extends parallel to the measuring chord 26 of the second measuring system 13.

Thus, the first vertical versine 12 ensues as the calculated vertical distance between the virtual measuring chord 28 and the track position point 29 which has been recorded during the measuring pass by means of the first measuring system 7 at the middle measuring point 17. The subsidence 19 under load at the middle measuring point 17 thus ensues as the difference of the first and the second vertical versine 12, 14, wherein the versines 12, 14 are signed.

Shown in FIG. 3 is a situation in which the virtual measuring chord 28 extends at the middle measuring point 17 between the non-loaded and loaded track 5. Then the two vertical versines 12, 14 have different signs, and the subtraction results in a summation of the values of both versines 12, 14. This is different in FIG. 4 where both versines 12, 14 show a track position arched upward. This situation corresponds to the regular case because as a rule the vertical versines 12, 14 of a track section are significantly bigger than a subsidence 19 under load.

FIG. 5 shows a second measuring system 13 without measuring trolleys 18, 24, 25. In this, the machine frame 2 serves as a common reference base for the three-point measurement. A non-contact distance measuring device 30 is arranged above each of the three measuring points 15, 16, 17. Thus, a respective distance 31, 32, 33 between a rail upper edge and the machine frame 2 is recorded at the three measuring points 15, 16, 17.

In a simple embodiment, only the distances 31, 32, 33 to one rail 4 are determined. However, for a determination of a subsidence 19 of both rails 4 or in the track center, distance measurements must be carried out for both rails 4. From the determined distances 31, 32, 33 it is possible in a simple manner to compute by means of the evaluation device 11 the second vertical versine 14 at the middle measuring point 17. Specifically, the difference of the middle distance 33 to a mean value of the two outer distances 31, 32 is determined. Additionally, by filtering the output signals of the distance measuring devices 30, interfering vibrations of the machine frame 2 can be eliminated.

The computation of the first vertical versine 12 takes place, as described with reference to FIG. 3, from the stored measuring values of the first measuring system 7 with respect to a virtual measuring chord 28.

For most cases of application, it is negligible if—for determining the second versine 14—the two outer measuring points 15, 16 do not lie exactly at the points of the greatest subsidence. This is the case if the outer measuring trolleys 24, 25 are arranged in front of or behind the loaded on-track undercarriages 3. In any case, hollow locations of the track 5 can be recorded reliably.

In order to nevertheless be able to exactly determine the subsidence of the track 5, in a further development of the invention, calculation codes of the track 5 (for example, modulus of foundation, or foundation modulus) are deposited in a memory of the evaluation device 11. Then, based on the recorded resilience or a bending curve of the track 5, a calculation of the maximum subsidence underneath the on-track undercarriages 3 takes place by means of the known method of Zimmermann.

The invention claimed is:

1. A method of surveying a track with two outer measuring points under load and with a central measuring point, lying therebetween, without load, the method comprising:

providing a track measuring vehicle with a machine frame supported on two on-track undercarriages for movement on the track;

providing a first measuring system for recording a vertical distance of the track under load and a second measuring system for recording a vertical distance of the track without load, wherein the first and second measuring systems have a common reference base with a chord having a defined chord length and wherein the first measuring system is coupled to an evaluation device;

computing with the evaluation device a course of a first vertical versine;

determining with the second measuring system a course of a second vertical versine;

wherein the first vertical versine and the second vertical versine are determined with an identical chord length and chord division; and computing a subsidence of the track under load by subtracting the second vertical versine from said first vertical versine or vice versa.

2. The method according to claims 1, which comprises determining the first vertical versine and the second vertical versine in a track center in each case, and thereby computing a median course of the subsidence of the track.

3. The method according to claim 1, which comprises determining the first vertical versine and the second vertical versine separately for two rails of the track, and computing the course of subsidence for each rail of the track.

* * * * *